United States Patent [19]

Cosma et al.

[11] 4,121,300

[45] Oct. 17, 1978

[54] BRINE MIXING APPARATUS

[75] Inventors: Earl Jesse Cosma, Chesterfield; William Bayard Tuley, Ballwin, both of Mo.

[73] Assignee: Ralston Purina Company, St. Louis, Mo.

[21] Appl. No.: 827,522

[22] Filed: Aug. 25, 1977

[51] Int. Cl.[2] ..... B10F 7/16

[52] U.S. Cl. ..... 366/251; 99/535; 366/282

[58] Field of Search ..... 366/163, 164, 165, 159, 366/241, 242, 244, 245, 249-251, 281, 282, 137; 426/265, 266, 332, 519; 99/535

[56] References Cited

U.S. PATENT DOCUMENTS

| | | | |
|---|---|---|---|
| 2,635,859 | 4/1953 | Dreyfus | 366/137 |
| 3,934,860 | 1/1976 | Michels et al. | 366/241 |
| 4,038,426 | 7/1977 | Jespersen et al. | 426/266 |

FOREIGN PATENT DOCUMENTS

| | | | |
|---|---|---|---|
| 7,200,827 | 7/1973 | Netherlands | 99/535 |

*Primary Examiner*—Leonard D. Christian
*Attorney, Agent, or Firm*—W. Dennis Drehkoff; Veo Peoples, Jr.

[57] ABSTRACT

A system for treating dry protein material in brine solutions comprises a tank for receiving the protein material and brine solution a container having a screened bottom end an agitator inserted through its open upper end for creating a vortex mixing action in the brine solution in which the container is immersed in the brine holding tank.

1 Claim, 1 Drawing Figure

BRINE MIXING APPARATUS

BACKGROUND OF THE INVENTION

This invention generally relates to mixing systems, and particularly those systems used to mix curing brines that contain added protein for use in meat products. These mixing systems have previously incorporated conventional agitation means. Most recently Tri-Blender® brand mixers, manufactured by the Ladish Company, Kenosha, Wis., have been employed for adding dry protein into the curing brine. The Tri-Blender® mixer has been employed because the protein has a tendency to coagulate and develop lumps during mixing unless a vortex is created. The Tri-Blender® mixer creates such a vortex during mixing and pulls the dry protein into solution. However, the Tri-Blender® mixer is quite expensive and impractical for many meat packing plants. In order to eliminate the Tri-Blender® mixer, attempts were made to pour the protein directly into the brine holding tank and mix, but the protein merely floated on top of the brine without going into solution even under agitation.

SUMMARY OF THE INVENTION

It is a general object of the present invention to provide an inexpensive, new and novel method for wetting powders, such as protein, into large tanks full of liquid, as is the case for a brine holding tank.

This object is fulfilled by first taking a container having one end open and one end closed, removing its closed end and replacing its closed end with a screen. Then additional screen or screens are inserted along the wall of the container, near its open end. This container is then placed inside of a large brine holding tank, an agitating means is inserted into the container and the brine is added to the holding tank which of course fills the container. The agitating means is turned on and the powdery protein is poured into the open end of the container. As agitation begins the system uniquely forms a vortex which pulls the brine through the screens on the wall of the inner container, dissolving the protein and carrying it down through the screened end of the container and then dispersing it throughout the volume of the brine holding tank.

DESCRIPTION OF THE DRAWING

FIG. 1 depicts a holding tank 1 which contains a brine solution, a smaller container 2 housed within the holding tank, the inlet screens 2a submerged just beneath the surface of the brine solution, outlet screen 2b at the bottom of the smaller container 2, and an agitating means 3 disposed within the smaller container 2. As the mixer 3 agitates the solution, a vortex action is created circulating a fluid flow into the inlet screens and out of the outlet screen.

DESCRIPTION OF THE PREFERRED EMBODIMENTS

Figure 1:
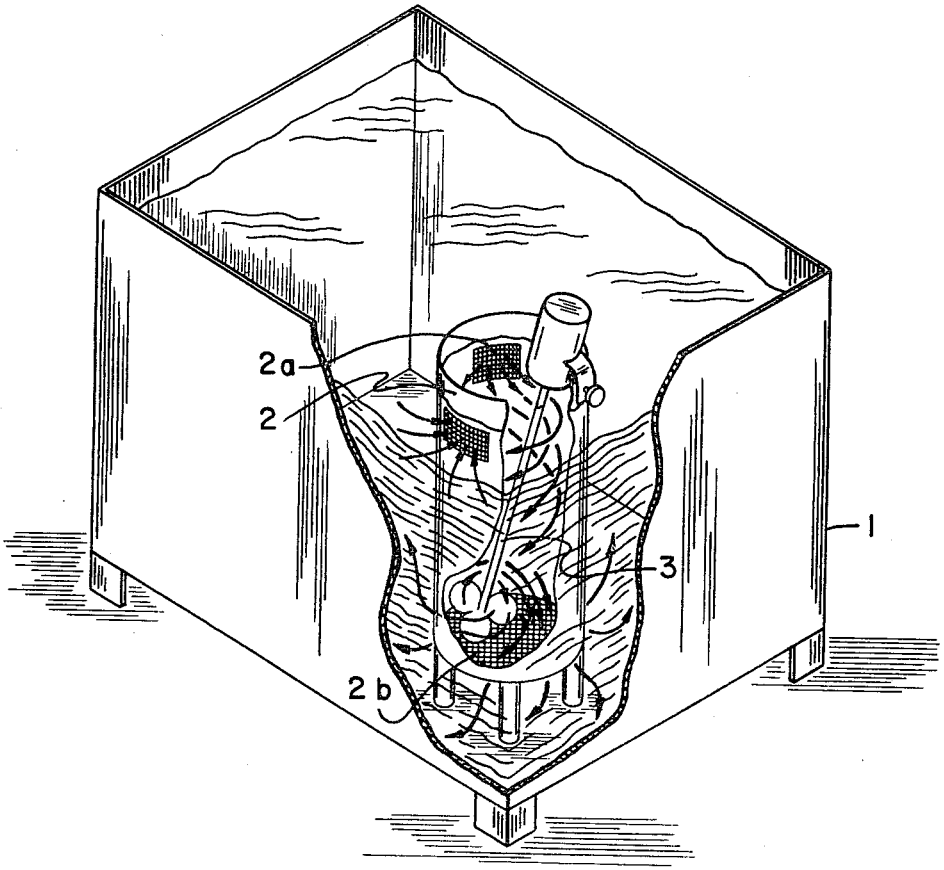
FIG. 1 is a perspective view of the apparatus of this invention.

The brine holding tank "1" is most commonly a rectangular vat commonly used to dissolve salt, phosphate or other dry materials. It is made of stainless steel can, having a volume of over 200 gallons.

The container "2" which is placed into the tank may be for example, a cylindrical stainless steel barrel or drum. The container is modified by placing screen mesh over its bottom end "2b" and over openings "2a" on the wall of the container near the top. The mesh size of the screen may vary depending on the size of the lumps which are to be screened out of the solution and depending upon whether a short or long dwell time in the container is desired.

The agitating means "3" which is placed within the container can be neumatically or electrically actuated and the propeller type agitators are preferred. Additionally, the brine may be simultaneously pumped out of the bottom of the tank "1" which enhances the mixing action.

Note that "dead areas" which receive little or no mixing or agitation action may develop in corners or along sides of tanks "1", especially if the tanks are square or rectangular. Accordingly, if desired more than one vortex mixing container "2" and/or agitator "3" may be employed within the tank "1".

When the agitating means "3" is started or pumping action is created, it pushes the liquid through the bottom screen "2b", consequently pulling the liquid through the upper screens "2a". It is herein possible to create and maintain a good vortex and vigorous agitation while circulating the entire contents of the tank and in the case of protein, full hydration occurs more effectively. It may be of note that a surfactant, if added to the protein would greatly aid its wettability and further effect hydration.

EXAMPLE

A thirty gallon stainless steel drum which has been modified by the aforementioned description is placed in a stainless steel meat tub or vat which is 48 inches × 36 inches × 36 inches. The drum has welded to it, 4 stainless steel angles for legs which extend its overall height to 37 inches. The drum's dimensions are 18 inches in diameter × 29 inches overall height by 28 inches deep. A model NAR-100 Lightnin' mixer manufactured by the Mixing Equipment Company, Inc., Rochester, N.Y., is attached to the small drum.

The position within the vat where the drum is placed is optional but for this example, it is placed in the corner of the vat. The upper screens are approximately 6 inches below the surface of the liquid. In this example the screen is U.S. standard 40 mesh.

The example cited here is to prepare a protein brine for ham pumping having the following composition:

| | % |
|---|---|
| Water | 80.59 |
| Soy Protein Isolate | 10.00 |
| Salt | 8.00 |
| Sodium Phosphate | 1.20 |
| Sodium Erythorbate | .16 |
| Sodium Nitrite | .05 |
| | 100.00% |

The specified amount of water is placed in the larger outer vat. The mixer is started in the small cylindrical barrel or drum. When a good vortex is obtained, the isolated soy protein powder is slowly added to the vortex and allowed to hydrate and disperse into the outer container through the bottom screen. After the protein has been completely dispersed in the liquid media, it is allowed to mix until it has become fully hydrated.

The phosphate is then added to the vortex in the small container and allowed to disperse and dissolve. At this point in time, the remaining ingredients, i.e., salt, sodium erythorbate and sodium nitrite is added to the mixing unit and allowed to disperse and dissolve.

What is claimed is:

1. An apparatus for dispersing powdery solids into a large reservoir of liquid; said apparatus comprising:

a. a holding tank;

b. a smaller tank disposed upright within the holding tank and said smaller tank having an open end and an opposite end covered with screen; said open end being directed upwardly and said screen covered end being directed downwardly; the walls of the smaller tank also having at least one strip of screen placed near but not touching the open end of the smaller tank;

c. the apparatus further comprising an agitating means disposed within the smaller container;

whereby the apparatus once filled with liquid and the agitating means once actuated will create a vortex mixing action which upon the solids being poured into the open end of the smaller container will disperse the solids and draw the liquid through the strip of screen and down through the bottom screen which catches all lumps while permitting the dispersed ingredients to flow throughout the volume of the larger container.

* * * * *